US005095579A

United States Patent [19]

Becker

[11] Patent Number: 5,095,579

[45] Date of Patent: Mar. 17, 1992

[54] CLEANING CENTER FOR USE IN A HOME, MOTOR VEHICLE AND THE LIKE

[76] Inventor: Brian E. Becker, 11250 W. Brandt Pl., Littleton, Colo. 80127

[21] Appl. No.: 480,973

[22] Filed: Feb. 16, 1990

[51] Int. Cl.[5] ..... A47L 9/00; A47J 47/18; B65D 6/18; B65D 21/02

[52] U.S. Cl. ..... 15/339; 15/264; 15/323; 220/4.26; 220/23.2; 220/500; 220/520; 220/527

[58] Field of Search ..... 15/323, 327.6, 264; 220/23.2, 527, 664, 4.26, 4.21, 500, 520, 523

[56] References Cited

U.S. PATENT DOCUMENTS

| | | | |
|---|---|---|---|
| 720,041 | 2/1903 | Mahon | 15/264 |
| 1,125,396 | 1/1915 | Rabinowitz . | |
| 2,525,633 | 10/1950 | Arnett | 224/48 |
| 2,885,714 | 5/1959 | Johnson | 15/331 |
| 2,935,760 | 5/1960 | Martink | 15/323.2 |
| 3,088,157 | 5/1963 | Aguilar | 15/323 |
| 3,159,862 | 12/1964 | MacFarland | 15/323 |
| 3,550,182 | 12/1970 | Kivela | 15/323 |
| 3,618,749 | 11/1971 | Vaccaro | 206/16 |
| 3,869,265 | 3/1975 | Wolter et al. | 55/274 |
| 4,111,505 | 9/1978 | Vice | 312/212 X |
| 4,162,031 | 7/1979 | Sommersby | 224/45 K |
| 4,184,602 | 1/1980 | Moliard | 220/4.26 |
| 4,195,728 | 4/1980 | Cardamone | 206/45.33 |
| 4,534,474 | 8/1985 | Ng | 211/70 |
| 4,993,551 | 2/1991 | Lindsay | 220/500 X |

OTHER PUBLICATIONS

Dzus Company—Folding Plastic Toggle Latch—411 Series—p. 82 of Catalog.

*Primary Examiner*—William A. Cuchlinski, Jr.
*Assistant Examiner*—James K. Folker
*Attorney, Agent, or Firm*—Norvell E. Von Behren

[57] ABSTRACT

A cleaning center for use in a home, motor vehicle or the like. The cleaning center is constructed with one or more outer caddy units which may be locked together and covered and locked with a lid. The caddy units are designed to store cleaning supplies and to prevent access to the supplies by small children. Each caddy unit has an internal cleaning device positioned in the center thereof with the home caddy having a vacuum cleaner unit and the auto caddy having a pail. The caddies as well as the internal cleaning devices are interchangeable and can be used separately and in various combinations.

16 Claims, 3 Drawing Sheets

CLEANING CENTER FOR USE IN A HOME, MOTOR VEHICLE AND THE LIKE

BACKGROUND OF THE INVENTION

This invention relates generally to cleaning devices and more particularly to a new and novel cleaning center for use in cleaning the inside of a home and also for use outside of the home such as cleaning the inside of a motor vehicle or the like.

In the daily or weekly cleaning of a residence, the owner and/or helper will generally use a vacuum sweeping unit with attachment, such as brushes and the like along with a separate head attachment for sweeping floors, rugs and others. The separate head attachment may be powered or not according to the type of sweeping unit purchased. Along with the basic sweeping unit, the home owner or helper such as the other or other person will also use an assortment of bottled cleaning supplies such as upholstery cleaners, rug spotters, cleaning solutions, etc., many of which are extremely toxic and can be very dangerous to children in the event they would be accidentally ingested by the child.

Many parents often leave such dangerous chemical supplies stored in various cupboards around the house where they can be easily seen and handled by children. It would be very desirable if the cleaning supplies could be stored in one safe place that could be locked when not in use and also could be easily transported around the house. It would also be very advantageous if other supplies such as rags, cloths, vacuum cleaner attachments could also be stored in the same proximity as the cleaning supplies.

In the cleaning of a motor vehicle, a similar set of conditions usually occur. The homeowner or helper, such as the father or other person will generally use a different group of cleaning supplies such as auto cleaners, waxes, auto upholstery spotters, and the like, many of which are also very dangerous to a child if ingested. In addition, the person cleaning the motor vehicle would often use a vacuum sweeping unit also for sweeping the floor and seats of the motor vehicle. It would also be very desirable if the motor vehicle cleaning supplies could be stored in a safe place that could be locked when not used and also could be easily transported to the motor vehicle outside of the house. It would also be advantageous if the rags, cloths and the like used in cleaning the motor vehicles as well as the vacuum cleaner attachments could also be stored in the vicinity of the cleaning supplies.

Since the vacuum cleaning unit is used both for cleaning inside the home and/or also for cleaning inside the motor vehicle, it would be advantageous to be able to easily use the vacuum cleaning unit in both locations without having to purchase separate units. However the typical home vacuum cleaner is often large being primarily designed for use in the home while the typical auto vacuum cleaner is often very small and compact, being designed primarily for use in cleaning the inside of the motor vehicle. It would also be very desirable if a single compact vacuum cleaner could be designed to accomplish both cleaning situations.

While cleaning inside the home or outside at the motor vehicle, the person doing the cleaning often needs a step stool to reach in out-of-the-way places. This situation usually requires the use of a separate stepping device which then must also be carried to the appropriate location when needed. It would be desirable to have such a device with the cleaning supplies and the vacuum cleaner at all times should the need for a step stool occur.

It is known in the prior art to provide separate devices for carrying groups of objects from one location to another. For example, I. Rabinowitz U.S. Pat. No. 1,125,396, issued on Jan. 19, 1915 teaches a carrier for toilet items which are carried in separate strap pockets. Similarly, G. A. Arnett U.S. Pat. No. 2,525,633, issued on Oct. 10, 1950 teaches the use of a multi-compartment bottle carrier for soft drinks, milk or the like. A similar functioning multi-compartment carrier is taught in J. R. Vaccaro U.S. Pat. No. 3,618,749, issued on Nov. 9, 1971. Here a plurality of plumber's tools are transported in the tool carrier by a rigid upright handle.

It is also known to design carriers for use in transporting several similar devices stacked on top of each other. For example, E. J. Summersby U.S. Pat. No. 4,162,031, issued on July 24, 1979 teaches the use of a computer tape reel carrier for carrying and storing computer tape reels. The concept of storing various items in a multi-use container is taught in P. A. Johnson U.S. Pat. No. 2,885,714, issued on May 12, 1959. Here a vacuum cleaner is stored inside of a hassock which has wheels positioned on the bottom.

Another type of multi-use outer container is taught in T. Cardamone U.S. Pat. No. 4,195,728, issued on Apr. 1, 1980. This container stores several inner containers such as motor oil, engine flush and engine additives inside the container with a transparent film surrounding the structure to permit viewing of the internal contents.

Vacuum cleaners have also been designed and used to store the tools used with the cleaner as typified in G. R. Wolter U.S. Pat. No. 3,869,265, issued on Mar. 4, 1975. This design uses a front and top compartment to house the various tubes, cord reel, brushes and the like used with the vacuum. A handle is affixed to the top of the vacuum and wheels are used on the bottom for transporting the complete device.

Nestable multi-compartment containers are shown and taught in the U.S. Pat. No. 4,534,474, issued on Aug. 13, 1985 to M. Ng of Kowloon, Hong Kong. This container is collapsible with three separate sections which nest together for shipping and then are assembled into a multi-tier kitchen utensil which is coupled together.

The before described typical prior art devices, while satisfactory for the purpose intended, do not satisfy the needs presented of an interchangeable cleaning device for use in cleaning the inside of a home and also cleaning the motor vehicle outside using and storing different cleaning supplies which can be locked inside the cleaning device for safety purposes.

SUMMARY OF THE INVENTION

In order to overcome the problems inherent in the prior art type of devices available, there has been provided by the subject invention a unique, novel cleaning center that may be used inside the home as well as outside of the home for cleaning both the inside of the home and a motor vehicle parked outside of the home and for storing and locking the cleaning supplies used for each application. The unique cleaning center is designed with one or more interchangeable caddy units that may be positioned on top of each other.

The bottom caddy unit is a home caddy and is formed with a plurality of inner compartments for use in storing the various assortment of home cleaning supplies. The inner compartments form an inside opening which extends vertically through the home caddy. A novel vacuum cleaner is designed to be positioned in the vertical opening and may be designed to be used as a step stool. The caddy as well as the vacuum cleaner has self contained handles for lifting each and means are provided to hold the vacuum cleaner and the home caddy together so that they both may be lifted together as a unit with the vacuum cleaner handle.

The upper caddy unit is an auto caddy and is formed the same as the home caddy thereby making it interchangeable with the home caddy. The auto caddy has an inner pail formed in the same general shape as the vacuum cleaner and is normally held together with the auto caddy by means that permit the pail and the auto caddy to be lifted together by the handle on the pail as desired.

The unique means for holding the home caddies to the inner vacuum cleaner and/or for holding the auto caddy to the inner pail also permits the caddies to be separated from the inner pail or vacuum cleaner and interchanged and/or used separately. The preferred embodiment of the means for holding the caddies together with the inner pail or vacuum as well as the other novel features of the invention will be detailed hereinafter when referring to the Description of the Preferred Embodiment.

The cleaning center also may be used with a separate power head of the type commonly used for cleaning rugs. A vacuum hose used with the power head or separately with brushes and other attachments is carried inside of a lid which is positioned on top of the upper auto caddy. Locking means are provided to lock the caddies together and to lock the internal contents, such as dangerous cleaning supplies, from children who may be harmed by the supplies. The lid may also be locked onto the separate home caddies if desired.

Accordingly, it is an object and advantage of the invention to provide a unique cleaning center than contains separate home and/or auto caddies with internally positioned devices contained within the individual caddies.

Another object and advantage of the invention is to provide a plurality of separate items that may be used together in a cleaning center or may be used with each other to form a home caddy and/or an auto caddy with the separate items also being capable of being used individually as desired.

Still yet another object and advantage of the invention is to provide a caddy unit that may be used to store and lock cleaning supplies while the caddy unit is not being used.

Yet another object and advantage of the invention is to provide a new and novel vacuum cleaner that may be positioned inside of and held together with a separate compartmentalized caddy unit with the vacuum cleaner capable of being used by itself and/or used as a step stool.

A further object and advantage of the invention is to provide a battery operated vacuum cleaner unit that may be used by itself or with separate caddy units and/or in combination with other items to be formed into a self-contained cleaning center.

These and other objects and advantages of the invention will become apparent after reviewing the drawings and studying the Description of the Preferred Embodiment hereinafter which is presented by way of illustration only and is not to be considered as limiting the spirit and scope of the invention.

DESCRIPTION OF THE PREFERRED EMBODIMENT

Figure 1:
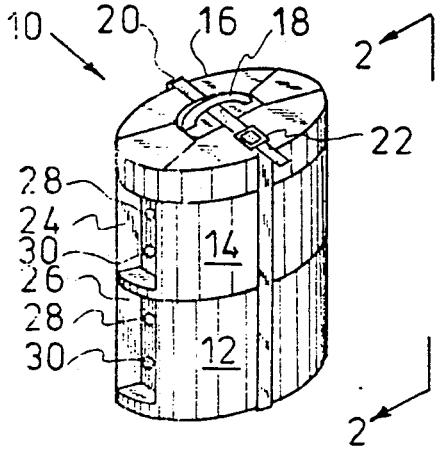
FIG. 1 is a perspective view of a prototype of the cleaning center of the invention showing a home caddy positioned below an auto caddy with a lid on top and with the caddies locked together.

Referring to the drawings in general and in particular to FIG. 1 of the drawings there is shown a perspective view of the prototype of the applicant's unique cleaning center shown generally by the numeral 10. A home caddy unit 12 is positioned below an auto caddy unit 14 and a lid 16 having a handle 18 is positioned on the top of the auto caddy 14. A strap 20 with a buckle 22 is used to hold and lock the prototype units together. Other means for locking the units together such as latches, locking latches and others may also be used within the spirit and scope of the invention.

The auto caddy unit 12 contains an indention 24 and the home caddy unit contains a similar indention 26 with intake openings 28 and electrical openings 30 as shown. For purposes of explaining the applicants unique cleaning unit, the caddy units 12 and 14 have been give separate numbers in the drawings but each caddy unit is constructed identical to the other caddy unit for purposed of interchangeability as will be discussed later. The home caddy unit 12 contains an inner positioned vacuum cleaner unit 48 while the auto caddy 14 contains an inner positioned cleaning pail or bucket 64 as will also be shown and described hereinafter.

Figure 2:
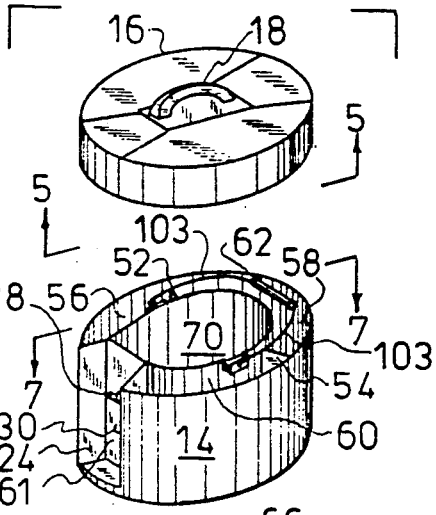
FIG. 2 is an end elevational view, taken along lines 2—2 of FIG. 1.
Figure 2:
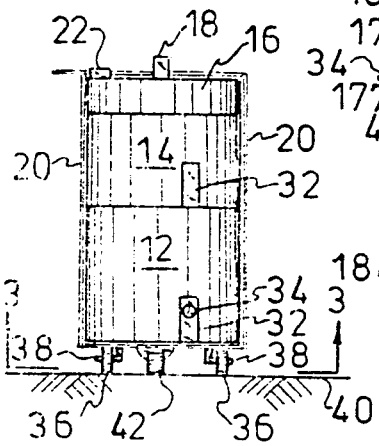

Referring now to FIG. 2 of the drawings, there is shown an end elevational view, taken along lines 2—2 of FIG. 1 and the indentation 32 contains a retractable electric plug 34 on the lower home caddy unit 12 as shown. Since the auto caddy 14 is constructed similarly to the home caddy 12, the indentation 32 is also contained on the caddy but no electric plug 34 is contained in the indentation.

The internally positioned vacuum cleaning unit 48 with the home caddy 12 contains a pair of retractable wheels 36 and a retractable caster wheel 42. The retractable wheels 36 are carried on the pivotable shafts 38. The vacuum cleaning unit 48 will be able to be rolled on the ground 40 along with the home caddy 12 and the upper auto caddy 14 with its internal pail or bucket 64 and the lid 16 as shown in FIG. 2.

Figure 3:
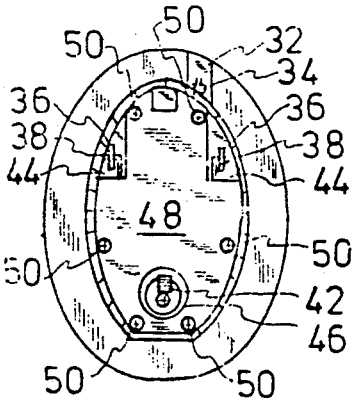
FIG. 3 is a bottom plan view, taken along lines 3—3 of FIG. 2.

Referring now to FIG. 3 of the drawing there is shown a bottom plan view, taken along lines 3—3 of FIG. 2 and further details the retractable wheels 36 and retractable caster wheel 42 are shown. A pair of recesses 44 are formed in the inner vacuum cleaner unit 48 to receive the wheels 36 when they are retracted. A recess 46 is also formed in the vacuum cleaner unit 48 to receive the retractable caster wheel 42. A plurality of rubber feet 50 are fixedly attached to the bottom surface of the vacuum cleaning unit 48 as shown in FIG. 3 by screws or some other means known in the fastening art.

The purpose of the retractable wheels 36 and the retractable caster 42 is to permit the cleaning unit 48 to be rolled about and then to be used as a step stool by standing on it was will be detailed more hereinafter. When the cleaning unit 48 is used as a step stool, the rubber feet 50 will ground on the surface 40 when the users weight is applied to the unit and as the wheels 36 and caster wheel 42 retract thereby making the unit stable enough to hold the weight of the user.

Figure 4:
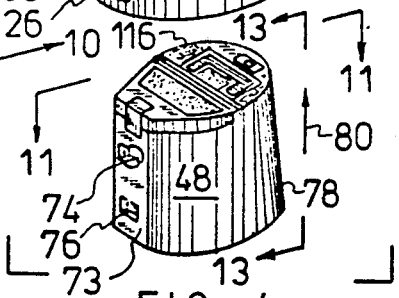
FIG. 4 is an exploded view, shown in the brackets, of the complete unique cleaning center shown in FIG. 1 and showing the individual components forming the center.

Referring now to FIG. 4 of the drawings, there is shown an exploded view, shown in the brackets, of the complete unique cleaning center 10 of FIG. 1. FIG. 4 shows how the individual components of the center which comprise similar caddy units 12 and 14 with a vacuum cleaning unit 48 positioned in the lower caddy unit 12. The caddy unit 12 is designated as the home caddy and would be generally used around the home. The upper caddy unit 14 contains a pail or bucket 64 and this caddy unit is designated as the auto caddy since it is generally used outside for cleaning the users automobile.

In the prototype shown, the caddy units 12 and 14 are formed in the shape shown with a plurality of inner compartments 56, 58 and 60 formed by the partition walls 52 and 54 which are formed integrally with the caddy unit.

When the caddy unit is formed in the shape shown the flat walls surface 61 in the indentation 24 is designed to be similar in shape to the flat wall surface 69 on the pail or bucket 64 and also to the flat wall surface 73 on the vacuum cleaning unit 48. Also the caddy units 12 and 14 are formed with tapered inner sides 70 which correspond to the tapered sides 68 on the pair or bucket 64 and also to the tapered sides 78 formed on the outside vertical surface of the vacuum cleaning unit 48.

When formed thusly it can be seen in FIG. 4, how the pail or bucket 64 is designed to be positioned upwardly in the direction of the arrow 72 and to fit inside the auto caddy 14. Similarly the vacuum cleaning unit 48 is designed to be positioned upwardly in the direction of the arrow 80 and to fit inside the home caddy 12. Because the home caddy 12 and the auto caddy 14 are constructed similarly with the tapered inside 70 and the tapers 68 and 78 are the same, the pail or bucket 64 can be interchanged with the vacuum cleaning unit 48.

The home caddy 12 and the auto caddy 14 have a moveable handle 62 and the pail or bucket 64 also contains a moveable handle 66 as shown. Accordingly the auto caddy 14 and the pail or bucket 64 may both be lifted by the pail handle 66 whenever the two are positioned together with the pail inside of the outer auto caddy. The internal tapered sides 70 on the auto caddy and the similar external tapered sides 68 on the pail 64 will permit them to be lifted together. When the user wants to lift only the outer auto caddy 14, he would lift the caddy by the caddy handle 62 instead of the pail handle 66.

Similarly the lower home caddy 12 and the internal vacuum cleaner unit 48 can be lifted together by the handle 116 on the vacuum cleaner unit which will be described more in detail hereinafter. Should it be desirable to lift the outer home caddy 12, then the user would lift the caddy alone by the caddy handle 62.

It can also be seen in FIG. 4 how the vacuum cleaner unit 48 contains an intake opening 74 and an electrical plug opening 76 which are positioned in line with the intake opening 28 and the electrical opening 30 on the caddy units 12 and 14. As before described, since the caddy units 12 and 14 are interchangeable on the pail 64 and the vacuum cleaning unit 48, the flat walls 61 on the caddies match up with the flat walls 69 and 73 on the pail and vacuum cleaner unit so that when the units are interchanged they cannot be turned 180 degrees or they will not fit together. As a result, the openings 28 and 30 will always line up with the mating intake opening 74 and electrical opening 76.

Figure 5:
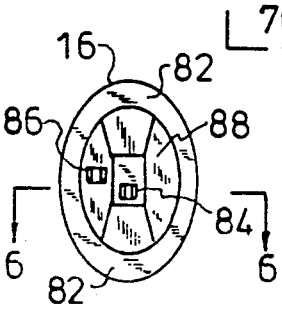
FIG. 5 is a bottom plan view, taken along lines 5—5 of FIG. 4, showing the inside of the lid and the clamping means for clamping and holding a vacuum hose used with the cleaning center.
Figure 6:
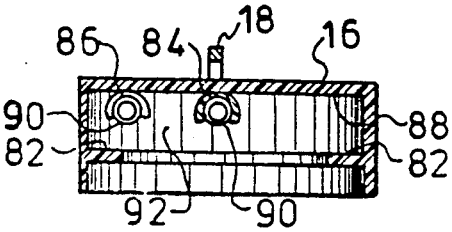
FIG. 6 is an enlarged cross sectional view, taken along line 6—6 of FIG. 5.

Referring now to FIG. 5 of the drawings there is shown a bottom plan view, taken along lines 5—5 of FIG. 4, showing the inside of the lid 16. The vacuum hose 90, shown in FIG. 15, which is used with the vacuum cleaning unit 48, may be carried in and stored inside of the lid 16. A ledge 82 is formed inside of the lid 16 as can be seen in FIG. 5 and also in FIG. 6 and is designed to hold the hose 90 within the lid. A plurality of hose clamps 84 and 86 are fixedly attached to the inside surface 88 of the lid 16 and are used to clamp portions of the hose 90 to hold the hose in conjunction with the ledge 82. FIG. 6 shows this and the clamped portions of the hose 90 are shown while the remainder of the hose has been eliminated for purposes of clarity. The opening 92 in the inside of the lid is sized to handle the desired length of hose 90 which can be coiled inside the opening.

Figure 7:
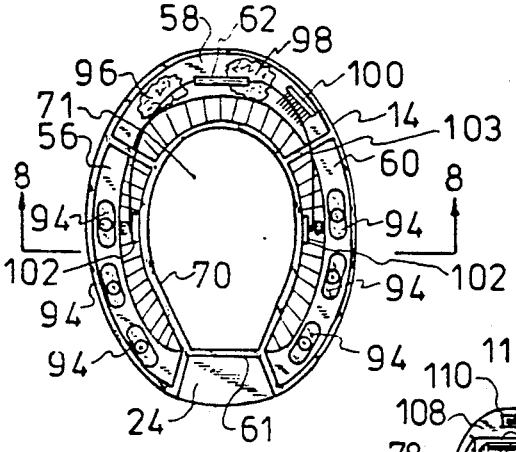
FIG. 7 is a top plan view, taken along line 7—7 of FIG. 4 showing the inside of the auto caddy which is also the same as the inside of the home caddy.

Referring now to FIG. 7 of the drawings, there is shown a top plan view, taken along lines 7—7 of FIG. 4 and showing the inside of the auto caddy 14 which is the same as the inside of the home caddy 12 as before described. A plurality of cleaning bottles or cans 94 such as polish, wax, cleaners may be positioned and stored in the compartments 56 and 60 and other supplies such as rags 96, sponges 98 and brushes 100 may be stored in the compartment 58 as needed.

Figure 8:
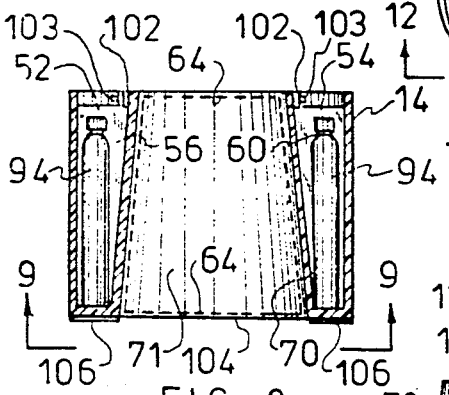
FIG. 8 is a cross sectional view, taken along line 8—8 of FIG. 7 showing a variety of cleaning supplies positioned inside the compartments formed by the caddy construction with the inner pail being shown in dashed lines.

The similarly constructed home caddy 12 may also contain cleaning supplies apropos to use in cleaning the home. Both caddies may be constructed with flanges 102 into which are positioned the ends of the wire 103 holding the handle 62. FIG. 8 is a cross sectional view, taken along lines 8—8 of FIG. 7 showing in more detail the shape of the compartments 56, 58 and 60 and showing how the cleaning supplies will fit in the compartments. It can also be seen how the partitions 52 and 54 are formed shorter than the top of the caddy to allow the handle 62 and handle wire 103 to lie flat. The dashed line 64 represents the pail and how it would fit in the opening 71 and could also represent the outline of the vacuum cleaning unit 48 which is sized to fit also.

It is desirable to form the caddy units 12 and 14 with a height of approximately 10 to 12 inches so that a large variety of off-the-shelf bottles and cans of cleaning supplies may be contained in the compartments 56, 58 and 60. It is also desirable to form the tapered sides 68 and 70 as well as the tapered side 70 with a taper of approximately 4 to 6 degrees when using this construction.

Figure 9:
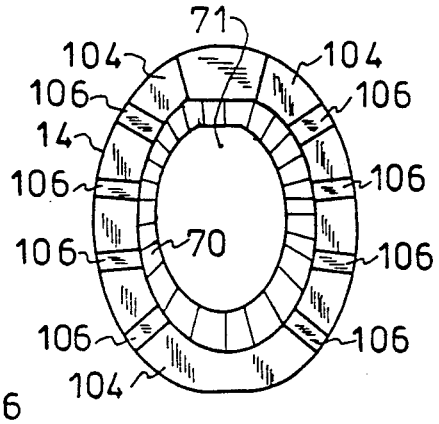
FIG. 9 is a bottom plan view, taken along line 9—9 of FIG. 8.

Referring now to FIG. 9 of the drawings, there is shown a bottom plan view, taken along line 9—9 of FIG. 8 showing the bottom surface 104 of the auto caddy which may be constructed with raised surfaces 106 as desired. There can also be seen in FIG. 9 the tapered construction of the tapered sides 70 forming the vertical opening 71 into which fits the pail 64 and/or the vacuum cleaning unit 48 as before described.

Figure 10:
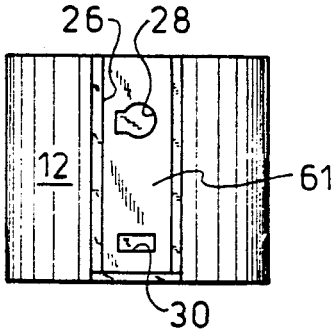
FIG. 10 is an end elevational view, taken along lines 10—10 of FIG. 4 of one end of both the home caddy and the auto caddy.

Referring now to FIG. 10 there is shown an end elevational view, taken along lines 10—10 of FIG. 4 showing in more detail the construction of the flat wall 61 of both caddies 12 and 14 and also the positioning of the intake opening 28 and the electrical opening 30. Turning now to FIGS. 11—16 there will be described in greater detail the construction of the novel vacuum cleaning unit 48.

Figure 11:
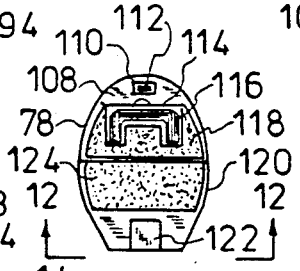
FIG. 11 is a reduced top plan view, taken along line 11—11 of FIG. 4 showing the top of the vacuum cleaner that is designed to fit interchangeably inside of both the home caddy and the auto caddy.

FIG. 11 is a reduced top plan view, taken along lines 11—11 of FIG. 4, showing the top surface 108 of the vacuum cleaning unit 48. Since the unit is designed to be also used as a step stool, a recess 110 contains a recessed switch 112 for turning on and off the cleaning unit 48. In this manner the switch 112 will not be damaged when the user of the device steps onto the top surface 108. In a similar manner, a recess 114 contains a recessed handle 116 which may be pivoted 90 degrees out of the recess to lift the vacuum cleaning unit 48. When a caddy unit 12 or 14 is positioned around the vacuum cleaning unit 48, the handle 116 will lift both the caddy and the vacuum.

A non-slip surface 118 may be applied to the top 108 of the use of tape or roughened top or by other means to prevent slipping on the top surface 108. A removable top 120 may also have a non-slip surface 124 applied thereto. The removable top 120 is held in place by a latch mechanism 122.

Figure 12:
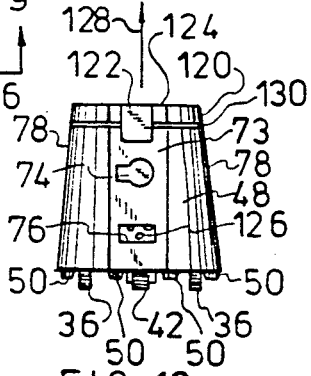
FIG. 12 is an end elevational view, taken along lines 12—12 of FIG. 11, of the vacuum cleaner unit.

FIG. 12 is an end elevational view, taken along lines 12—12 of FIG. 11 and shows the relative position of the intake opening 74 for the vacuum and the electrically grounded three prong electrical plug 126. It can be seen in FIG. 12 how the removable top 120 is pivoted upwardly in there direction of the arrow 128 to expose the filter compartment 130 of the vacuum.

Figure 13:
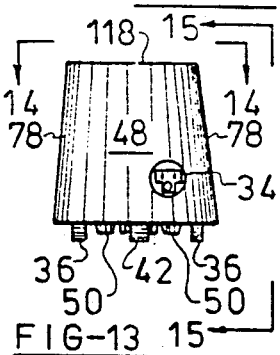
FIG. 13 is another end elevational view, taken along line 13—13 of FIG. 4 showing the end opposite to the end shown in FIG. 12.
Figure 14:
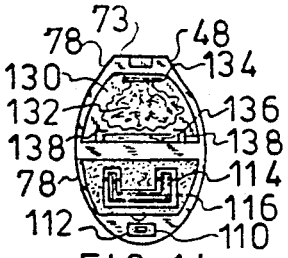
FIG. 14 is a reduced top plan view, taken along lines 14—14 of FIG. 13, similar to the view of FIG. 11 and showing the vacuum cleaner lid removed to expose the removable filter bag contained within the vacuum cleaner.

FIG. 13 is another end elevational view, taken along lines 13—13 of FIG. 4 and shows the end opposite to the end shown in FIG. 12. The position of the retractable electrical three prong plug is shown and this plug is used to electrically connect the vacuum to 110–120 house voltage. FIG. 14 is a reduced top plan view, taken along lines 14—14 of FIG. 13 and is similar to the view of FIG. 11 but with the top cover 120 removed.

The filter compartment 130 of the vacuum cleaning unit 48 contains a removable filter bag 132 which is held in place by the filter bag attachment 134.

Figure 15:
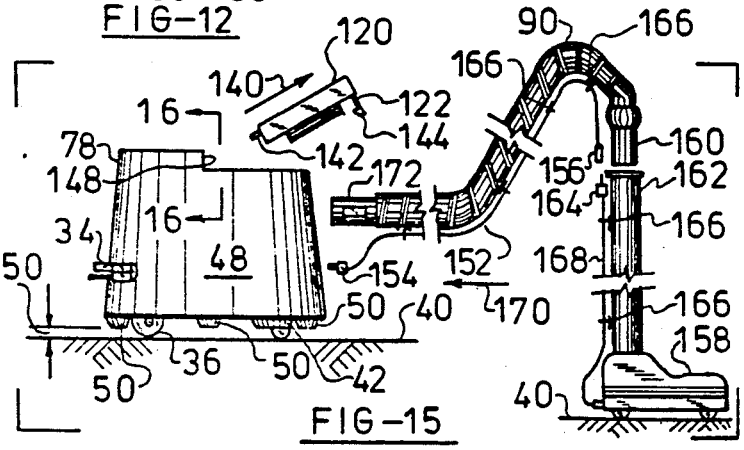
FIG. 15 is a side elevational view, taken along lines 15—15 of FIG. 13, showing the lid being removed and also showing how the separate power head may be used with the cleaning center.

A removable filter 136 may also be used and is held in place by the angled filter frames 138. As before described, access to the filter compartment 130 is by means of the removable top 120. FIG. 15 is a side elevational view, taken along lines 15—15 of FIG. 13 and shows how the removable top 120 is moved outwardly in the direction of the arrow 140. A pair of male lugs 142 protrude from the end of the top 120 and are positioned in the female openings 146 on the vertical surface 148.

Figure 16:
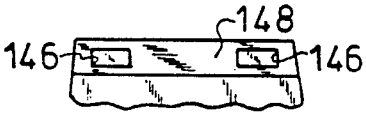
FIG. 16 is an elevational view, taken along line 16—16 of FIG. 15 showing more detail of the opening in the vacuum cleaner case for use with the removable lid.

The female openings 146 can also be seen in FIG. 16 of the drawings. The removable top cover 120 is held in place by the locking latch 122 with a locking protuberance 144 of the type known in the art of fastening. There can be also seen in FIG. 15 how the vacuum cleaning unit 48 may be used as a step stool. As before described, the retractable wheels 36 along with the retractable caster wheel 42 will recess into the vacuum case when the case is stepped on by a user. When this happens, the rubber feet 50 will move downwardly the distance shown by the arrow 150 until they hit the ground 40.

The applicants novel cleaning center 10 may be used as shown and also may be used with a separate power head 158 of the type commonly used with home vacuum sweepers. Since the power head 158 may be used outdoors, it would be preferred to use a grounded male plug 154 for plugging into the mating grounded female plug 126 on the vacuum unit 48. The electrical wires 152 would then connect to the female plug 156 at the male inlet tube 160 for the vacuum hose which plugs into the female exhaust inlet 162.

A mating male grounded plug 164 is then used on the female inlet tube of the power unit and clips 166 are used to hold the electrical wires 152 and 168 in place as shown. The power head hose inlet 172 may then be positioned, in the direction shown by the arrow 170, into the intake opening 74 on the vacuum cleaning unit 48.

Figure 17:
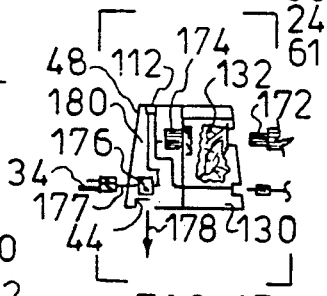
FIG. 17 is a diagrammatic view of the vacuum cleaner unit showing the internal components inside the housing of the vacuum cleaner.
Figure 18:
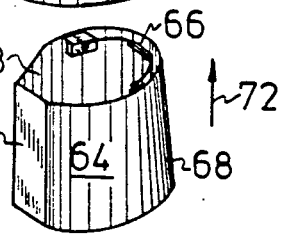
FIG. 18 is a diagrammatic view of the vacuum cleaner unit similar to the view of FIG. 17 showing how the vacuum cleaner unit may have a self contained battery pack positioned inside the housing of the vacuum cleaner.
Figure 18:
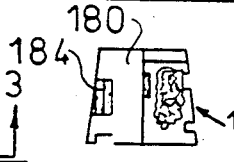

FIGS. 17 and 18 are similar diagrammatic views of the vacuum cleaning unit 48 showing the usual internal components found inside of a vacuum cleaner housing. In FIG. 17 there can be seen an exhauster 174 positioned behind the filter 136 to exhaust air through the filter and the filter bag 132. The switch 112 turns the exhauster 174 on and off and is connected to the electric plug 34 as shown. A retraction mechanism 176 of known types is used to retract the electrical wire 177 inside the vacuum chamber 180.

Exhaust out of the vacuum chamber 180 is through the recesses 44 in the direction shown by the arrows 178. The recesses 44 are also used to contain the retractable wheels 36 as before described and shown in FIG. 3. FIG. 18 shows a modified vacuum cleaning unit 182 which contains a rechargeable battery pack that may be used in place of the standard plug 34 if desired. Access to the rechargeable batteries may be by known means in the art and the battery pack 184 may also be positioned elsewhere if desired.

Figure 19:
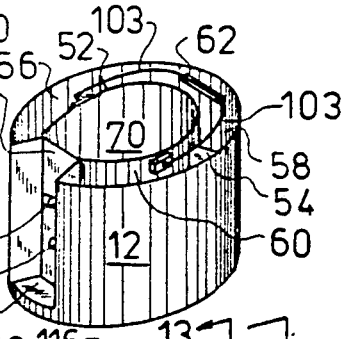
FIG. 19 is a side elevational view showing how one of the caddy units may be used separately with the pail and with the lid positioned on top thereof.
Figure 19:
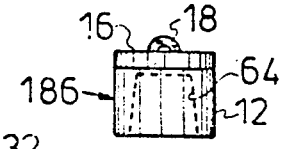

From the foregoing it can be seen how the unique cleaning center may be used as shown in FIG. 1 and it may also be sold and/or used as shown in FIG. 19 by the numeral 186. A caddy unit, either the home caddy 12 or the auto caddy 14, and be used and sold with a lid 16. The dashed line 64 represents the pail and could also represent the vacuum cleaning unit 48 if sold and used in that combination.

While in the original prototype shown in FIGS. 1-19 the means for locking the caddies 12 and 14 together to the lid 16 has been shown as the strap 20, other means such as latches, locking latches and others are considered to be within the spirit and scope of the invention. When thusly locked, the potentially dangerous chemical cleaning supplies 94 will be inaccessible to small children who may be harmed by them.

Figures 20, 21, 22, 23, 24, 25, 26, 27, 28, 29, 30, 31, 32, 33, 34, 35:
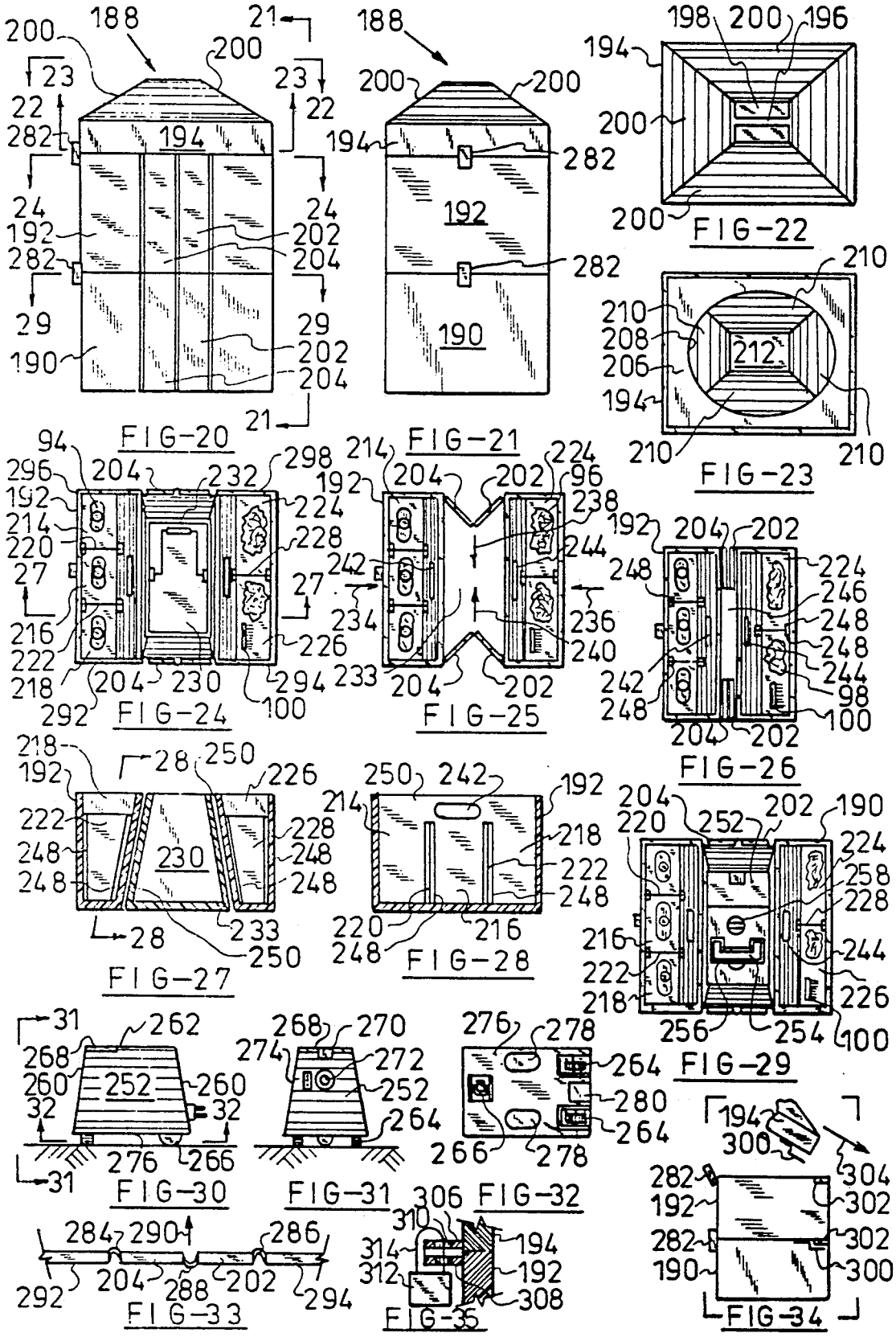
FIG. 20 is a side elevational view of a modified cleaning unit formed generally in a rectangular configuration.
FIG. 21 is an end elevational view, taken along lines 21—21 of FIG. 20.
FIG. 22 is a top plan view, taken along lines 22—22 of FIG. 20 showing the lid used with the modified cleaning unit.
FIG. 23 is a bottom plan view, taken along lines 23—23 of FIG. 20 showing detail of the construction of the inside of the lid.
FIG. 24 is a top plan view, taken along lines 24—24 of FIG. 20, showing details of the modified auto caddy unit used with the embodiment of FIG. 20.
FIG. 25 is a top plan view, similar to the view of FIG. 24, showing how the modified caddy unit is formed with foldable walls.
FIG. 26 is a top plan view, similar to the view of FIG. 25, showing how the foldable walls permit the compartments of the caddy unit to be positioned close together for easier carrying.
FIG. 27 is a cross sectional elevational view, taken along lines 27—27 of FIG. 24.
FIG. 28 is a cross sectional elevational view, taken along lines 28—28 of FIG. 27.
FIG. 29 is a top plan view, taken along lines 29—29 of FIG. 20 showing details of the modified home caddy unit.
FIG. 30 is a reduced side elevational view of the modified vacuum unit used with the cleaning unit of FIG. 20.
FIG. 31 is an end elevational view, taken along lines 31—31 of FIG. 30.
FIG. 32 is a bottom plan view, taken along lines 32—32 of FIG. 30.
FIG. 33 is an enlarged top plan view of the foldable walls showing the construction of the integral hinges used on the walls to permit them to fold inwardly as shown in FIG. 25.
FIG. 34 is a reduced side diagrammatic view of the modified cleaning unit of FIG. 20 showing how the caddy units are locked together and how the lid is locked to the caddy units.
FIG. 35 is an enlarged cross sectional view showing how the lid and/or caddy units may be locked together.

Turning now to FIGS. 20-35, there will be shown and described a modified and improved form of the applicants basic unique cleaning center shown generally by the numeral 188 in FIG. 20. The improved production form of the invention has been designed basically in a rectangular shape as shown with improvements in the lid 194 and in the outer home caddy 190 and the auto caddy 192. These improvements will be discussed hereinafter when referring to the particular figures of the drawing.

It can be seen in FIG. 20, how the improved lid 194 has been designed with sloping sides 200 which will prevent the user from standing on the lid and breaking it. FIG. 22 is a top plan view of the lid, taken along lines 22—22 of FIG. 20 and the lid has been further improved by recessing the handle 196 in the recess 198 all of which are formed integrally with the lid. FIG. 23 is a bottom plan view of the lid, taken along line 23—23 of FIG. 20. The internal construction of the lid 194 is similar to that of the lid shown in FIGS. 5 and 6 with the exception of an elliptical shape opening 208 which forms the ledge 206 to hold the vacuum hose between the ledge and the underside 210 of the sloped top. FIG. 23 shows the position of the bottom 212 of the handle recess 198 and the clamps 84 and 86 used in the prototype have been omitted for clarity but would also be used to hold the vacuum hose 90 in place inside of the lid 194.

The home caddy 190 and the auto caddy 192 have been designed in the improved production model 188 with hinged walls 202 and 204 separating the compartments 214, 216 and 218 and the opposite compartments 224 and 226. This is seen in FIG. 24 which is a top plan view, taken along lines 24—24 of FIG. 20. The partitions 220 and 222 have been designed to be removable as will be discussed more fully hereinafter. The partition 228 separating the compartments 224 and 226 has also been designed to be removable.

Contained inside the improved auto caddy 192 is a pail or bucket 230 with a handle 232 similar to the pail 64 but formed in a rectangular shape instead. The pail 230 is also formed with tapered sides as is the auto caddy 192 and the home caddy 190 as well as the vacuum cleaning unit 252 for the purposes before described. The tapers form one means of holding the outer caddies to the inner pail or vacuum unit so that they may both be lifted and transported together as a unit. Other holding means are considered to be within the spirit and scope of the invention.

Referring now to FIGS. 25 and 26 there will be described the improved construction of both the home caddy 190 and the auto caddy 192 using the hinged walls 202 and 204. FIG. 25 is a top plan view, similar to the view of FIG. 24 with the rectangular pail 230 removed. By forming the caddies 190 and 192 as shown with hinged walls 202 and 204, the entire caddy can be compressed or made smaller as shown in FIG. 25 by applying a light force in the direction of the arrows 234 and 236 which will cause the hinged walls 202 and 204 to move inwardly in the direction shown by the arrows 238 and 240. The opening 233 which previously contained the pail 230 or the vacuum cleaning unit 252 thereby becomes smaller until the caddy unit assumes the narrow form shown in FIG. 26. The space 246 between the opposite sides of the caddy is now compressed as shown and the integrally formed handle openings 242 and 244 may be used to carry the caddy with one hand instead of using both hands. Further detail of the hinged wall construction will be discussed hereinafter when referring to FIG. 33 of the drawings.

In FIGS. 24 and 26 there can be seen how the partitions 220, 222 and 228 can be made removable if desired. Elongated square bars 248 are spaced apart and are fixedly attached to the inside of the caddy as shown or are formed there when the caddy is manufactured. The partitions are then free to slide between the spaced apart bars.

FIGS. 27 and 28 show the placement of the partitions in the compartments and show how the previously described taper is formed on the sloped inner sides 250 of the caddies. FIG. 27 shows also the sloped construction of the rectangular pail 230.

Turning now to FIG. 29 there will be described in more detail the vacuum cleaner unit 252 which is also formed in a rectangular shape. FIG. 29 is a top plan view, taken along lines 29—29 of FIG. 20 and shows the rectangular shaped vacuum cleaning unit 252 positioned inside the outer home caddy 190. A handle 252 is positioned in the recess 256 and may also be pivoted 90 degrees to a vertical position. A locking latch 258 with a horizontal rod may be positioned within the top and may also be used to provide a more positive lock to lock the inner vacuum unit 252 in holes (not shown) in the outer home caddy 190 than the locking provided by the tapered sloped side 260 on the vacuum unit 252 as before described.

The modified rectangular shaped vacuum cleaning unit 252 may also be designed to be used as a step stool so that the user may step on the top surface 262 and retractable wheels 264 and a retractable caster wheel 266 are used for this purpose.

A removable top 268 and locking latch 270 are used as before described to provide access to the filter compartment of the vacuum cleaner unit. The other features of the rectangular shaped vacuum cleaning unit are similar to the previous unit 48 desired in FIGS. 12–15 such as the intake opening 272 and the grounded three prong electrical plug 274 for the power head 158 when the power head is used. Because of the improved rectangular shape used the bottom surface 276 of the vacuum unit shown in FIG. 32 the bottom has been modified to provide a pair of exhaust openings 278 and intake opening 280 as shown.

Referring now to FIG. 33 there is shown an enlarged top plan view of the foldable walls 202 and 204 which are formed by known plastic forming techniques with integral plastic hinges 284 and 286 to the end walls 292 and 294 of the caddy as shown. In addition, the foldable walls 202 and 204 are hinged together by an integral plastic hinge 288 as shown. When constructed as shown, the walls 202 and 204 will move inwardly as shown by the arrow 290, in FIG. 33, and as shown by the arrows 238 and 240 in FIG. 25 due to the biased construction of the integral hinge. The movement will be a small amount enough to cause the walls 202 and 204 always to move in the proper direction inwardly and not outwardly.

The foldable walls 202 and 204 are formed on the opposite end walls 296 and 298 in a similar manner as can be seen more clearly in FIG. 24.

Referring now to FIGS. 34 and 35 as well as FIGS. 20 and 21, there will be discussed how the respective caddies 190 and 192 may be locked together to each other and to the lid 194 to prevent accidental exposure of the caddies cleaning supplies to young children. FIG. 34 is a reduced side diagrammatic view, shown in brackets. A hook 300 may be shaped as shown and may be fixedly attached to the lid 194 as well as to the bottom of the auto caddy 192. The hook 300 is designed to engage the tabs 302 formed on the bottom surfaces of the caddies 190 and 192.

When positioning the lid 194 onto the auto caddy 192 as shown, the lid would be moved in the direction shown by the arrow 304 until the hook 300 engages the tab 302. This will hold one side of the lid or caddy to the adjacent caddy. Referring now to FIGS. 20 and 21 there will be seen a plurality of folding plastic toggle latches 282 of the type commonly used for locking opposing items together. One type of toggle latch that may be used would be as manufactured by Dzus Company and known as their 411 series. These latches consist of a one-piece segmented latch body and a strike that couples to the body's base in a closed position. Other types of latches are within the spirit and scope of the invention. For an absolute type of lock, the design of FIG. 35 may be incorporated into the latches 282 or may be positioned close by. A pair of flanges 306 and 308 may be formed on or fixedly attached to the lid 194 and the caddy 192 and 190. The flanges 306 and 308 would have mating holes 310 through which the arm 314 of a padlock 312 could be positioned.

When positively locked, then the accidental exposure of the internal cleaning supplies 94 would be eliminated making the unique cleaning center a safe place to store dangerous chemical supplies. While the latch and lock just described may be used as shown, it is within the spirit and scope of the invention that other designs may be used and the applicant is not to be limited to those shown and described.

From the foregoing, the applicants unique cleaning center provides a novel pair of caddies that are designed to be interchangeable with a pail and a vacuum cleaner unit. Dangerous cleaning supplies can be locked in either or both caddies with the novel lockable lid which is also designed to store a vacuum hose. The cleaning center may also be constructed with more than two stacked caddy units within the spirit and scope of the invention.

The novel taper construction used on the embodiments shown on the interior of the caddies, on the exterior of the pail and on the exterior of the vacuum cleaning unit permits the caddy and its interior device (pail or vacuum) to be carried together or used separately. There are other means available for holding the outer caddy and the inner pail and/or vacuum unit together so that they may be lifted together or separately, such as a step construction, the use of latches or the like. These and other variations are considered to be within the spirit and scope of the applicants invention and the applicant is not to be limited to the taper construction shown and described.

The novel vacuum unit is also designed to be used separately as a step stool as well as a vacuum and may be run on batteries and also may be used with a separate "UL" approved power head for either indoor or outdoor use. This makes the applicants invention more versatile in many applications and also more appealing to a potential purchaser of the unit.

The unique construction of the applicants design thereby provides a multi-use cleaning device with individual parts which may be used together or separately and may also be used in various combination. While the prototype and production embodiments have been shown by way of illustration, it should be apparent that changes such as before described and other changes may be made in the various parts and the arrangement of the parts. The applicant is not to be limited to the exact embodiments shown and described as these have been given by way of illustration only.

Having described my invention, I claim:

1. A cleaning center for use in cleaning the inside of a home and also for use outside of the home such as cleaning the inside of a motor vehicle or the like, comprising:

(a) at least two interchangeable caddy units positioned one on top of the other;

(1) one of the caddy units comprising an outer home caddy having formed therein a plurality of inner compartments for use in storing assorted cleaning supplies:

the inner compartments forming an inside opening extending vertically through the home caddy;

first means, associated with the inner compartments, for lifting and transporting the home caddy from one place to another;

an inner vacuum cleaning unit, positioned in the vertical opening and having at least an intake opening for attaching a vacuum hose to the vacuum cleaning unit and at least one electrical plug connection;

second means, associated with the inner vacuum cleaning unit, for lifting and transporting the vacuum cleaning unit from one place to another;

means, associated with the outer home caddy and the inner vacuum cleaning unit for holding the outer home caddy and the inner vacuum cleaning unit together so that they both may be lifted by the second means for lifting and transporting associated with the inner vacuum cleaning unit;

(2) another of the caddy units comprising an outer auto caddy having formed therein a plurality of inner compartments for use in storing assorted cleaning supplies;

the inner compartments forming an inside opening vertically extending through the auto caddy;

third means, associated with the inner compartments, for lifting and transporting the auto caddy from one place to another;

an inner pail, positioned in the vertical opening;

fourth means, associated with the inner pail, for lifting and transporting the inner pail from one place to another;

means, associated with the outer auto caddy and the inner pail for holding the outer auto caddy and the inner pail together so that they may both be lifted by the fourth means for lifting and transporting associated with the inner pail;

(b) means, associated with the home caddy and the auto caddy for locking the caddies together whenever they are to be moved as a single unit from one place to another; and (c) a lid, positioned on top of the locked together caddies, the lid containing an inner shelf and also containing a vacuum hose, supported by the inner shelf, for use with the vacuum cleaning unit;

(1) means, associated with the lid and at least one of the caddies for locking the lid to at least one of the caddies so that the cleaning supplies may be locked thereby preventing children, infants, unauthorized persons and the like from having access to the cleaning supplies and being harmed by the supplies.

2. The cleaning center as defined in claim 1 wherein the means for holding the outer home caddy and the inner vacuum cleaning unit together comprises a taper formed on the vacuum unit and on the inside vertical opening extending through the home caddy.

3. The cleaning center as defined in claim 1 wherein the means for holding the outer auto caddy and the inner pail together comprises a taper formed on the pair and on the inside vertical opening extending through the auto caddy.

4. The cleaning center as defined in claim 1 wherein the first, second, third and fourth means for lifting and transporting comprises handles pivotably attached to their respective parts of the cleaning center.

5. The cleaning center as defined in claim 1 further comprising one of the interchangeable caddy units having associated therewith a plurality of wheels for rolling the cleaning unit from one position to another.

6. The cleaning center as defined in claim 5 wherein the plurality of wheels are attached to the inner vacuum cleaning unit and are retractable to the inside of the vacuum unit.

7. The cleaning center as defined in claim 6 further comprising the inner vacuum unit having formed thereon a plurality of pads in proximity to the wheels so that the inner vacuum unit may be used as a stepping stool by a user of the unit standing on the vacuum unit with the wheels retracting into the vacuum unit until the pads touch the ground on which the vacuum unit stands when used as a stepping stool.

8. The cleaning center as defined in claim 1 further comprising:

(d) a separate power head for use with the inner vacuum cleaning unit with the power head used for cleaning floors, rugs, carpet, upholstery and the like.

9. The cleaning center as defined in claim 8 further comprising the vacuum hose having attached thereto a grounded electrical cord for attachment to the power head and to the inner vacuum cleaning unit so that the vacuum cleaning unit may be approved for use indoors and outdoors.

10. A caddy unit having a top and a bottom and for use in storing an assortment of cleaning supplies and for use with various separate externally used devices comprising:

(a) at least one upright outside wall;

(b) at least one upright inside wall, spaced apart from the outside wall;

(c) the outside wall and the inside wall being constructed and joined in a manner so as to form a totally enclosed centrally located vertical opening extending vertically through the caddy unit, the totally enclosed centrally located vertical opening being sized and configured for receiving and containing the separate externally used device positioned in the central opening;

(d) means, associated with the inside wall and the outside wall, to position the walls in a spaced apart relationship and to form a plurality of compartment walls forming compartments between the inside and outside wall and in proximity to the centrally located opening but not within the centrally located opening and having an open top and a closed bottom on each compartment, the compartment walls extending upwardly in proximity to the top of the caddy unit, the compartments being used for storage of the cleaning supplies and for holding and preventing movement of the cleaning supplies from one compartment to another compartment;

(e) at least one bottom, fixedly attached to at least the inside wall and the outside wall to close only the bottom of the compartments, and not the vertical opening extending through the caddy unit; and (f) means, associated with the caddy unit, for lifting and transporting the caddy unit from one place to another.

11. The caddy unit as defined in claim 10 wherein the separate externally used device is a vacuum unit.

12. The caddy unit as defined in claim 10 wherein the separate externally used device is a pail.

13. A caddy unit for use in storing an assortment of cleaning supplies and for use with various separate externally used devices, comprising:

(a) at least one upright outside wall;

(b) at least one upright inside wall, spaced apart from the outside wall and forming a centrally located opening vertically extending through the caddy unit;

(c) means, associated with the inside wall and the outside wall, to position the walls in a spaced apart relationship and to form a plurality of compartments in proximity to the centrally located opening and having an open top and a closed bottom on each compartment, the compartments being used for storage of the cleaning supplies, the compartments being formed as spaced apart compartments on each side of the centrally located opening, with the spaced apart compartments being attached together by hinged end walls which permit the spaced apart compartments to move together and apart as desired thereby permitting the caddy unit to be picked up and carried more easily;

(d) at least one bottom, fixedly attached to at least the inside wall and the outside wall to close only the bottom of the compartments, and not the vertical opening extending through the caddy unit;

(e) means, associated with the caddy unit, for lifting and transporting the caddy unit from one place to another;

(f) the centrally located vertical opening is formed in a predetermined size and configuration for positioning and containing the separate externally used device; and (g) the caddy unit is formed in a generally rectangular shaped configuration having a height of approximately ten to twelve inches thereby allowing the plurality of compartments to hold a large variety of off-the-shelf bottles of cleaning supplies.

14. A caddy unit for use in storing an assortment of cleaning supplies and for use with various separate externally used devices, comprising:

(a) at least one upright outside wall;

(b) at least one upright inside wall, spaced apart from the outside wall and forming a centrally located opening vertically extending through the caddy unit;

(c) means, associated with the inside wall and the outside wall, to position the walls in a spaced apart relationship and to form a plurality of compartments in proximity to the centrally located opening and having an open top and a closed bottom on each compartment, the compartments being used for storage of the cleaning supplies;

(d) at least one bottom, fixedly attached to at least the inside wall and the outside wall to close only the bottom of the compartments, and not the vertical opening extending through the caddy unit;

(e) means, associated with the caddy unit, for lifting and transporting the caddy unit from one place to another;

(f) the centrally located vertical opining being formed in a predetermined size and configuration for positioning and containing the separate eternally used device; and (g) a separate lid being fixedly attached to the caddy unit with the lid being formed with a sloped top surface to prevent the lid from being stepped on by the user of the caddy unit.

15. A caddy unit for use in storing an assortment of cleaning supplies and for use with various separate externally used devices, comprising:

(a) at least one upright outside wall;

(b) at least one upright inside wall, spaced apart from the outside wall;

(c) the outside wall and the inside wall being constructed and joined in a manner so as to form a totally enclosed centrally located vertical opening extending vertically through the caddy unit, the totally enclosed centrally located vertical opening being sized and configured for receiving and containing the separate externally used device, the centrally located vertical opening of the caddy unit being formed in a generally elliptical shaped configuration having at least one flat end, the elliptical shaped configuration and the flat end conforming to the shape of the separate externally used device and permitting the separate externally used device to be positioned inside the caddy unit only in one position;

(d) means, associated with the inside wall and the outside wall, to position the walls in a spaced apart relationship and to form a plurality of compartments in proximity to the centrally located opening and having an open top and a closed bottom on each compartment, the compartments being used for storage of the cleaning supplies;

(e) at least one bottom, fixedly attached to at least the inside wall and the outside wall to close only the bottom of the compartments, and not the vertical opening extending through the caddy unit; and (f) means, associated with the caddy unit, for lifting and transporting the caddy unit from one place to another.

16. The caddy unit as defined in claim 10 wherein the caddy unit is formed in a generally rectangular shaped configuration with hinged end walls connecting the upright outside wall and the upright inside wall with the caddy unit having a height of approximately ten to twelve inches thereby allowing the plurality of compartments to hold a large variety of off-the-shelf bottles of cleaning supplies.

* * * * *